US007878106B2

(12) United States Patent
Hu

(10) Patent No.: US 7,878,106 B2
(45) Date of Patent: Feb. 1, 2011

(54) FIRING CONTROL MECHANISM FOR TOY GUN

(76) Inventor: Shih-Che Hu, No. 2, Lane 256, Yen Ho Street, Yung Kang City, Tainan Hsien (TW)

( * ) Notice: Subject to any disclaimer, the term of this patent is extended or adjusted under 35 U.S.C. 154(b) by 158 days.

(21) Appl. No.: 12/427,274

(22) Filed: Apr. 21, 2009

(65) Prior Publication Data

US 2010/0229843 A1 Sep. 16, 2010

(51) Int. Cl.
*F41A 19/04* (2006.01)

(52) U.S. Cl. ..... 89/129.02

(58) Field of Classification Search ..... 89/129.01–131
See application file for complete search history.

(56) References Cited

U.S. PATENT DOCUMENTS 3,204,529 A * 9/1965 Silsby ..... 89/140
3,247,611 A * 4/1966 Wilson ..... 42/69.01
3,292,492 A * 12/1966 Sturtevant ..... 89/128
3,559,630 A * 2/1971 Frye ..... 124/2
3,774,500 A * 11/1973 Into ..... 89/129.01
3,847,054 A * 11/1974 Ruger et al. ..... 89/129.02
4,095,507 A * 6/1978 Close ..... 89/129.02
5,760,328 A * 6/1998 Robbins ..... 89/129.02

* cited by examiner

*Primary Examiner*—Troy Chambers
(74) *Attorney, Agent, or Firm*—Pro-Techtor Int'l Services; Ralph Willgohs

(57) ABSTRACT

A firing control mechanism for an air-soft toy gun is disclosed for enabling a user to rotate a switch in selecting a single shot, 3-shot continuous firing, multi-shot continuous firing or safety lock mode, having a ratchet wheel pivotally mounted on an axle of the hammer thereof, which ratchet having two shadow teeth and one deep tooth arranged in a series around the periphery at one side and sloping teeth arranged around the periphery at an opposite side. The hammer has a stop rod meshed with one sloping tooth of the ratchet wheel. During a continuous 3-shot firing action, the ratchet wheel is rotated following down stroke of the hammer, and a pawl is meshed with one shadow tooth or the deep tooth, and the stop rod of the hammer is shifted into mesh with a next sloping tooth of the ratchet wheel to prohibit reverse rotation of the ratchet wheel when the hammer is returned after a firing action.

3 Claims, 13 Drawing Sheets

FIRING CONTROL MECHANISM FOR TOY GUN

BACKGROUND OF THE INVENTION

1. Field of the Invention

The present invention relates to a toy guns and more particularly, to a firing control mechanism for toy gun that allows control of single-shot, 3-shot continuous firings multi-shot continuous firing, or safety lock mode.

2. Description of the Related Art

Regular air-soft guns do not produce an anti-personal force, however they are designed like a real gun, for example, they have an outer appearance like a real gun or produce a feedback vibration. With respect to firing control, an air-soft gun, for example, the design of Taiwan Patent Publication Number 334844 allows selection of the function of single-shot, 3-shot continuous firing, multi-shot continuous firing, or safety lock mode.

The firing control mechanism according to Taiwan Patent Publication Number 334844 comprises a bolt, a hammer, a trigger, a hammer hook, a continuous firing control rod and a switch. The switch is located on one side of the gun body, having an operation lever. Further, a link is provided inside the gun body, having a cut to match the operation of the trigger. The location and width of the cut are determined subject to actual requirements such as the operation of safety lock, single-shot, 3-shot and multi-shot. Further, ratchet wheel and pawl may be added to match the hammer hook and continuous firing control rod.

Further, the hammer and the ratchet wheel are pivotally connected together by an axle. The ratchet wheel is for rotation in one single direction, having on its one side two series of teeth each including two shadow teeth and one deep tooth. By means of forcing the pawl into engagement with the shadow teeth or deep tooth, 3-shot continuous firing control function is achieved. However, this design does not teach the way how to have the ratchet wheel be rotated in one single direction. The invention has been accomplished to prevent reverse rotation of the ratchet wheel, assuring positive firing control.

SUMMARY OF THE INVENTION

The present invention has been accomplished under the circumstances in view. It is one object of the present invention to provide a firing control mechanism for air-soft toy gun, which allows selection of single shot, 3-shot continuous firing, multi-shot continuous firing or safety lock mode subject to the action of a continuous firing control rod and a ratchet wheel and effectively prohibits reverse rotation of the ratchet wheel to assuring positive action of the selected mode.

To achieve this and other objects of the present invention, a firing control mechanism for air-soft toy gun in accordance with the present invention comprises a bolt, a hammer, a trigger, a switch, a hammer hook, a continuous firing control rod, the hammer having a hooked portion located on the bottom side thereof for hooking by the hammer hook and an axle, a ratchet wheel mounted on the axle of the hammer for rotation on the axle in one single direction, the ratchet wheel having at least one series of shadow and deep teeth arranged around the periphery thereof at one side, each series of teeth including two shadow teeth and one deep tooth, a pawl provided at one side of the hammer hook for engaging the ratchet wheel, the switch comprising a link that has at least three cuts, the position of the at least three cuts being changed relative to the hammer hook, the pawl and the continuous firing control rod when the switch is rotated, the hammer hook, the pawl and the continuous firing control rod cach having a bearing portion respectively controllable to engage one cut of the link for entering one of single shot firing mode, 3-shot continuous firing mode, multi-shot continuously firing mode and safety lock mode. The ratchet wheel has a plurality of sloping teeth equiangularly arranged around the periphery thereof at an opposite side. The number of the sloping teeth is equal to the total number of the teeth of the at least one series of shadow and deep teeth. The hammer has a stop rod meshed with one sloping tooth of the ratchet wheel. The stop rod of the hammer is shifted into mesh with a next sloping tooth of the ratchet wheel to prohibit reverse rotation of the ratchet wheel when said hammer is returned after a forward rotation subject to a hammering action of said hammer.

Further, the stop rod extends through the hammer, having a rear end supported on a spring member at the hammer.

Further, the hammer has a locating plate affixed to one side thereof and stopped at one side of the spring member against the rear end of the stop rod.

BRIEF DESCRIPTION OF THE DRAWINGS

FIG, 1 is an exploded view of a firing control mechanism for air-soft toy gun in accordance with present invention.

FIG, 13 is a schematic drawing of the present invention, showing the status of the firing control mechanism at the third shot during a continuous 3-shot firing operation.

Figure 14:
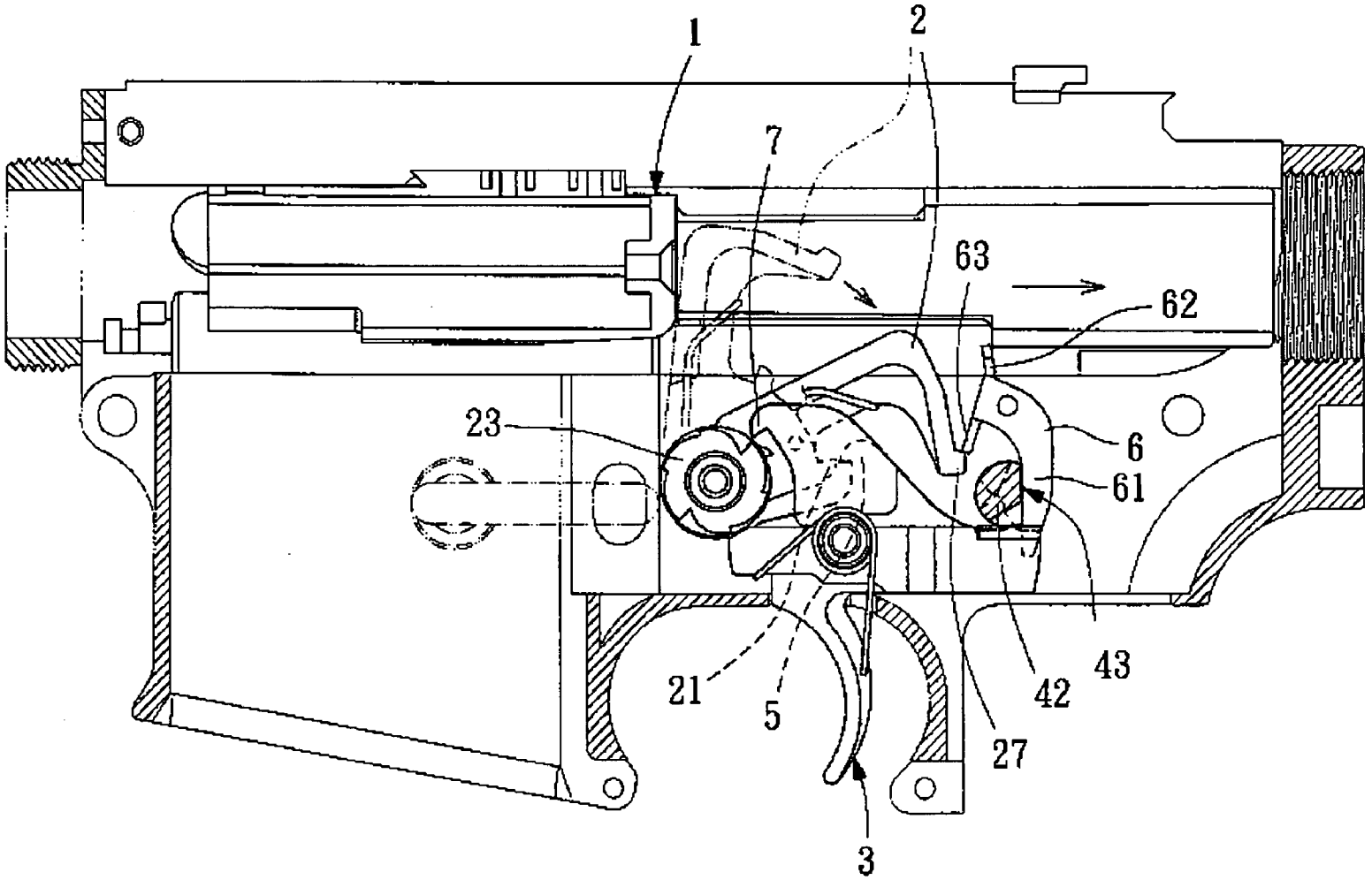

FIG. 14 is a schematic drawing of the present invention, showing the status of the firing control mechanism during a continuous multi-shot firing operation.

Figure 15:
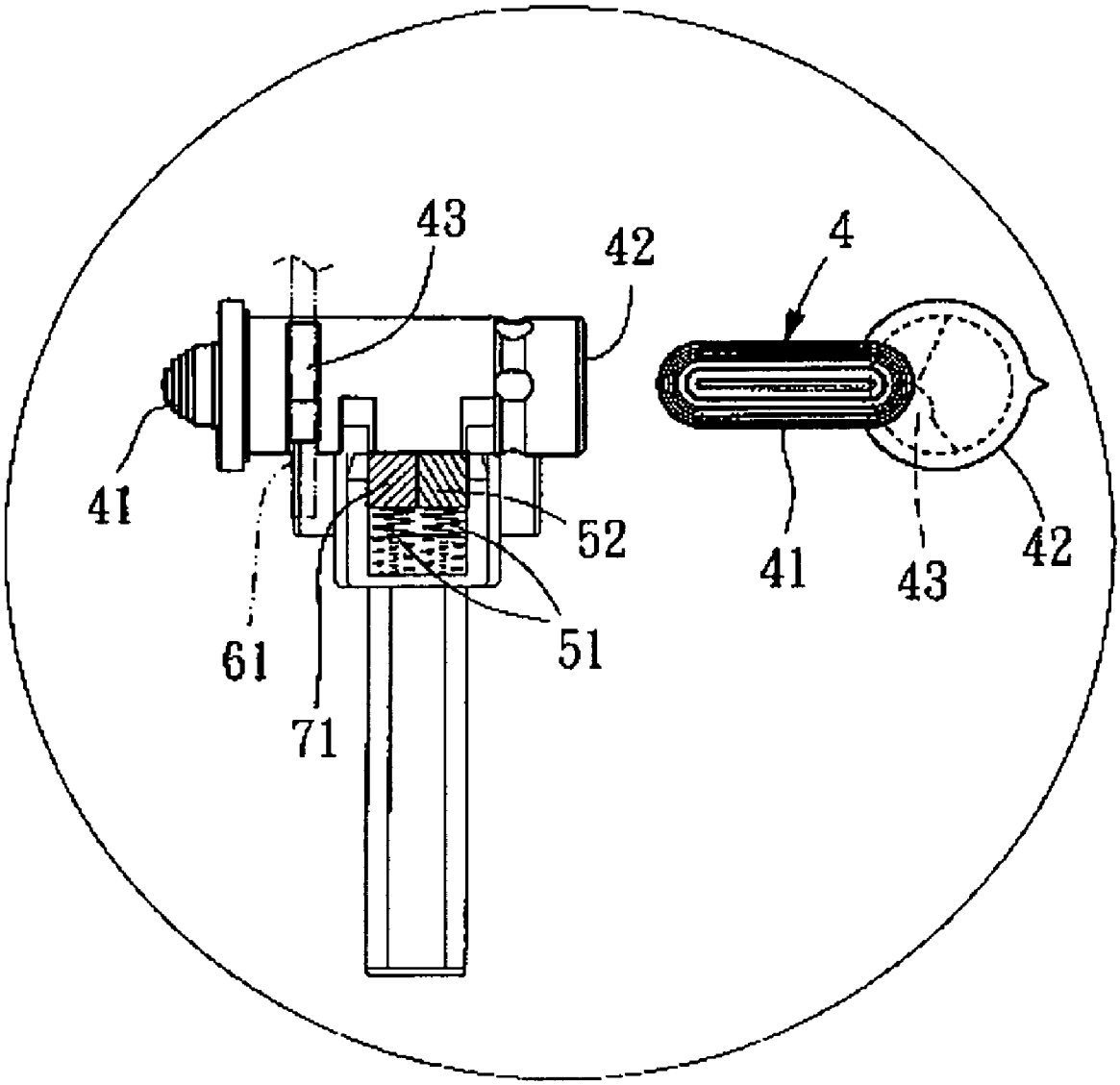

FIG. 15 is a schematic drawing of the present invention, showing the structure and positioning of the switch during a continuous multi-shot firing operation of the firing control mechanism.

DETAILED DESCRIPTION OF THE PREFERRED EMBODIMENT

Figure 1:
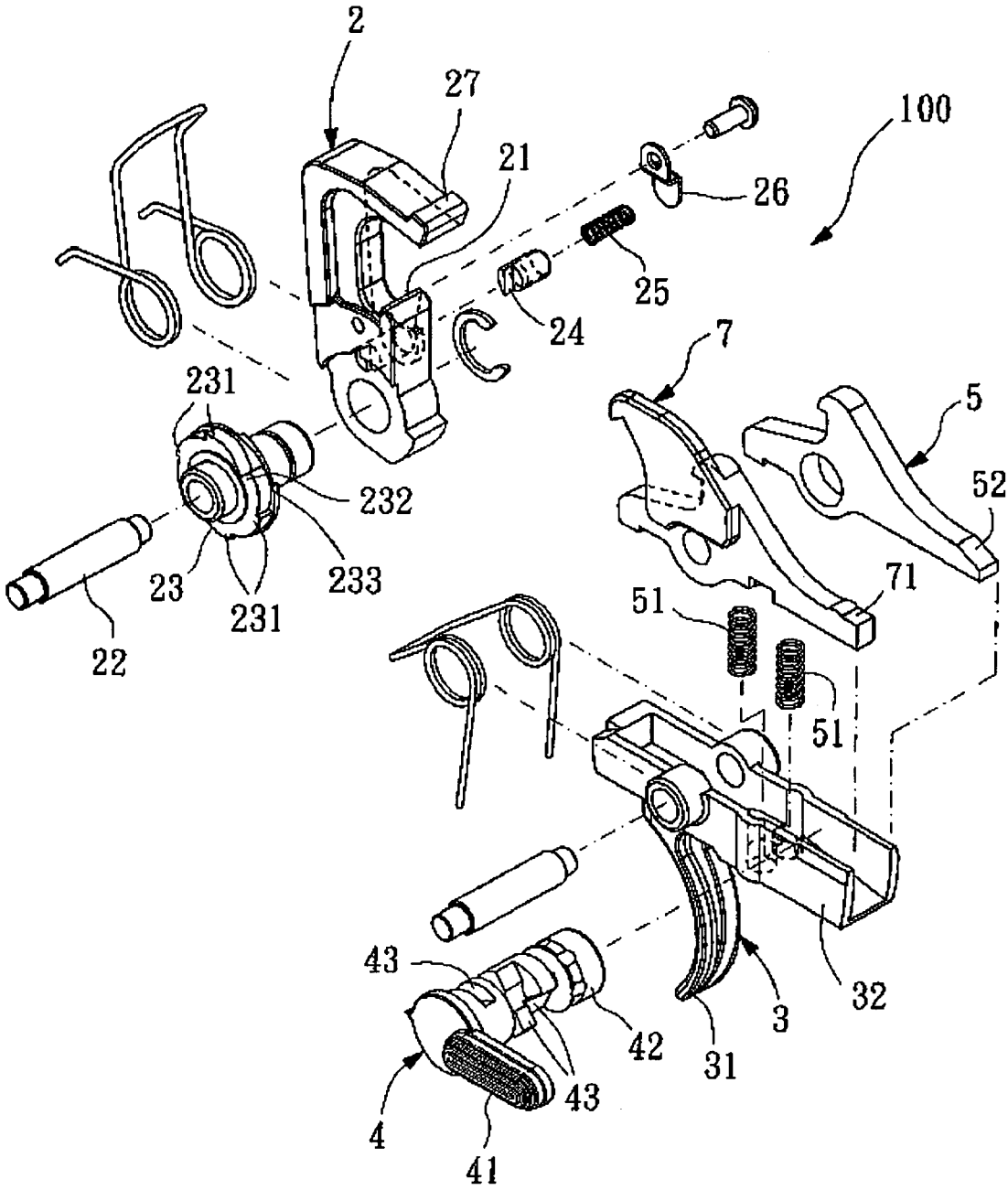
Figure 2:
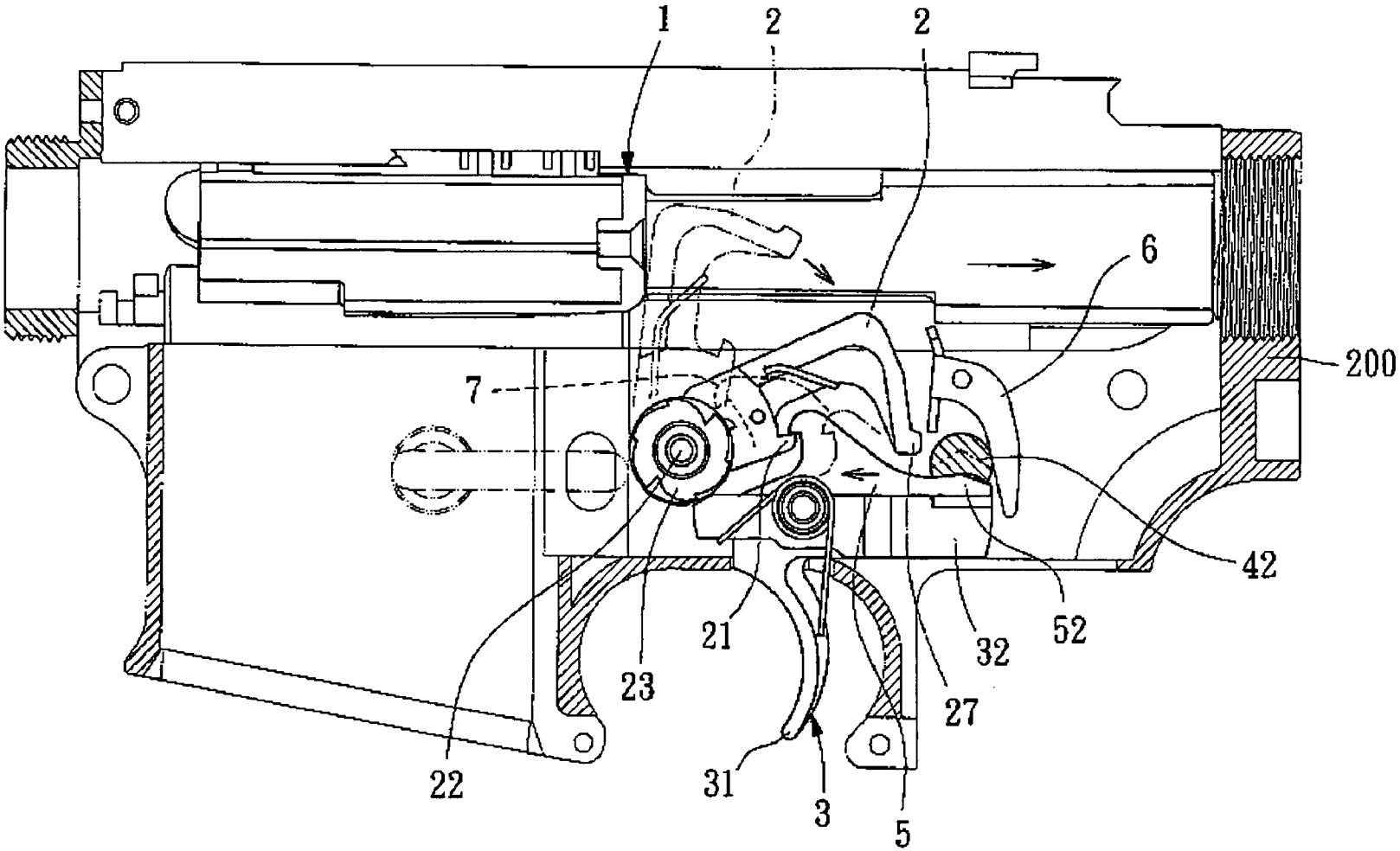
FIG. 2 is a schematic sectional view of the present invention, showing the operation of the single shot firing mode of the firing control mechanism.

Referring to FIG. 1, a firing control mechanism 100 for air-soft toy gun in accordance with the present invention is shown comprising a bolt 1 (sec also FIG. 2), a hammer 2, a trigger 3, a switch 4, a hammer hook 5, and a continuous firing control rod 6 (see also FIG. 2).

The bolt 1 is mounted in the top side of the gun body 200 and movable forwards and backwards.

Figure 3:
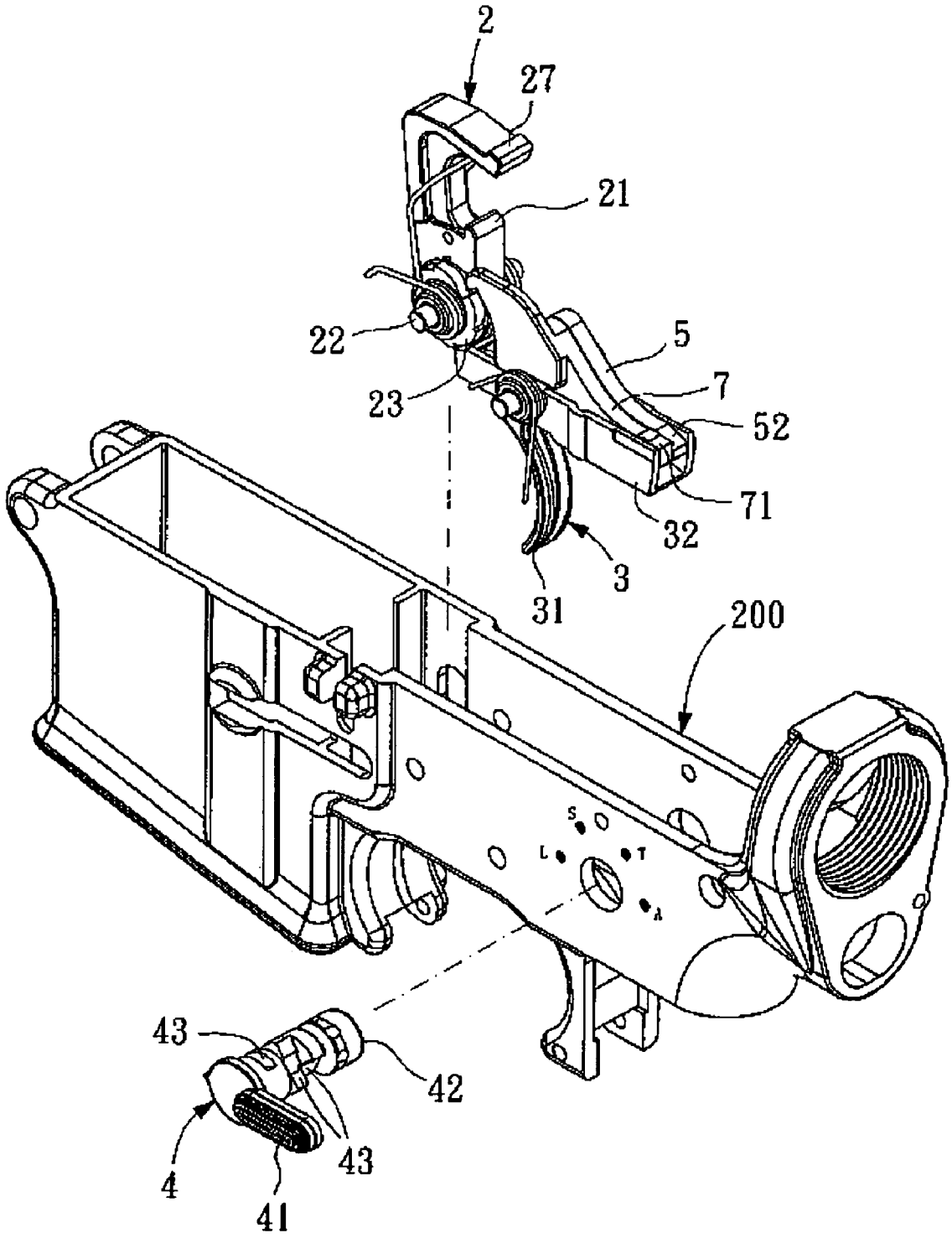
FIG. 3 is an enlarged view of the present invention, showing the firing control mechanism partially assembled.
Figure 4:
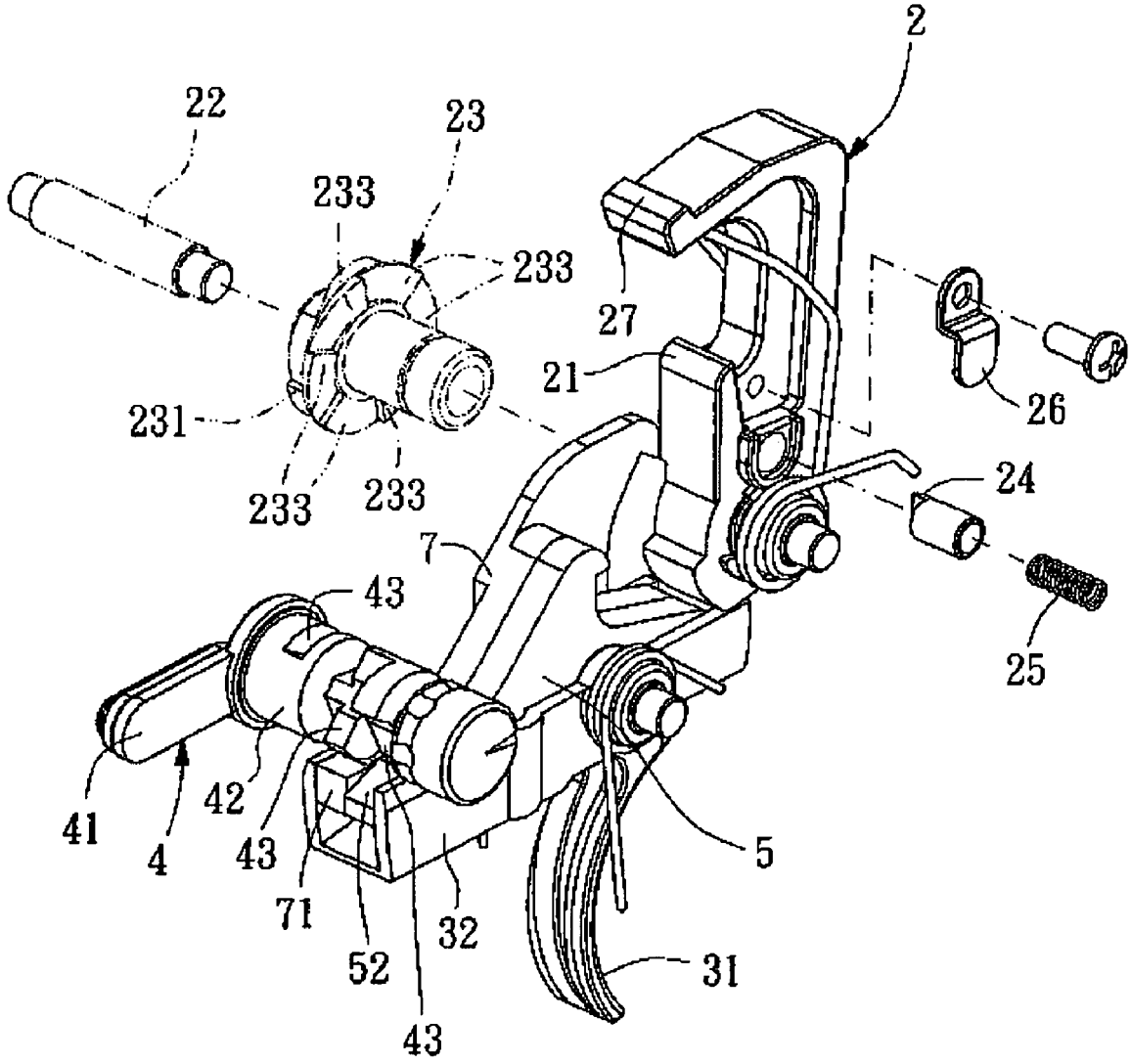
FIG. 4 is another enlarged view of the present invention, showing the firing control mechanism partially assembled.
Figure 5:
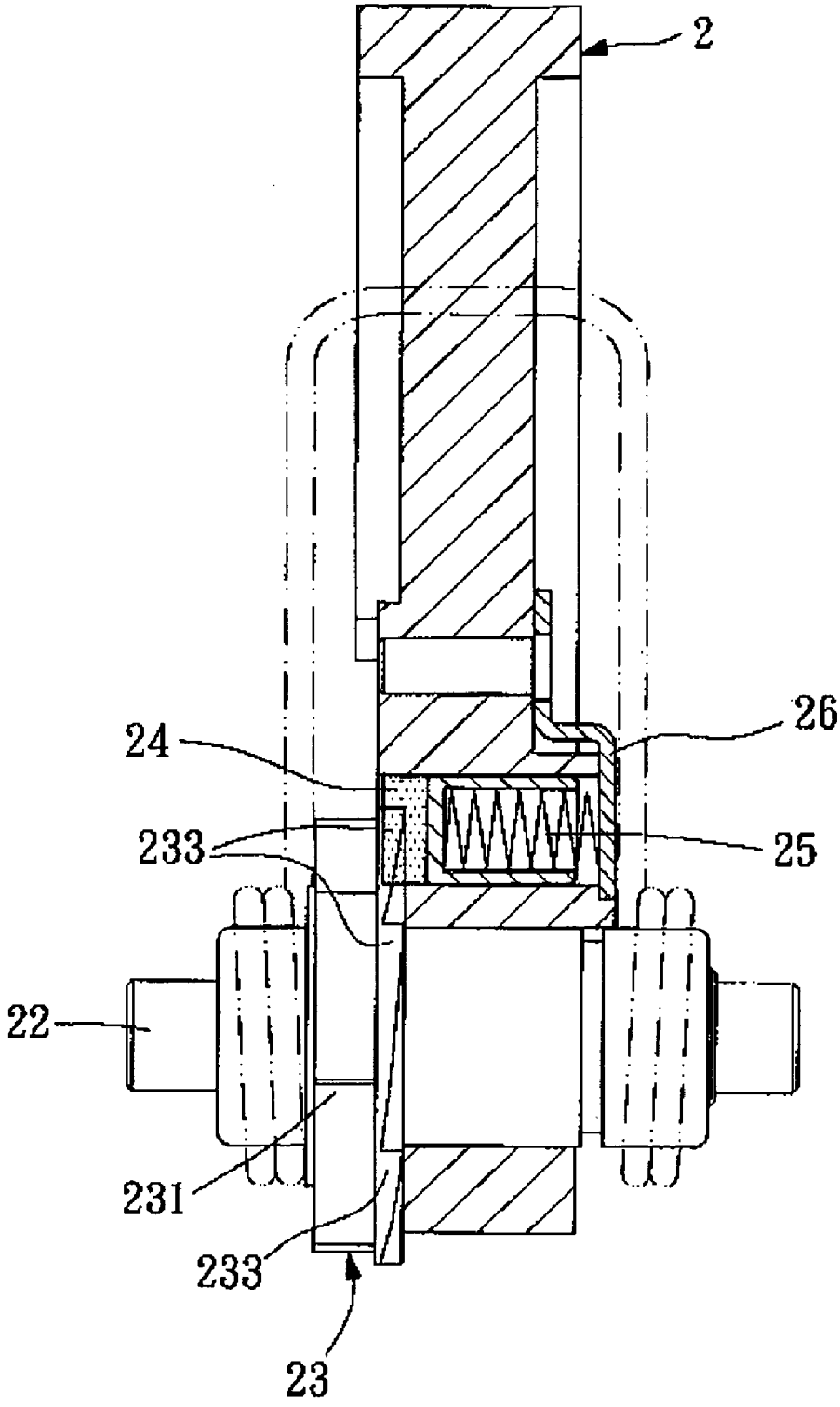
FIG. 5 is a schematic sectional view of the present invention, showing the stop rod meshed with the ratchet wheel.
Figures 6, 7, 8:
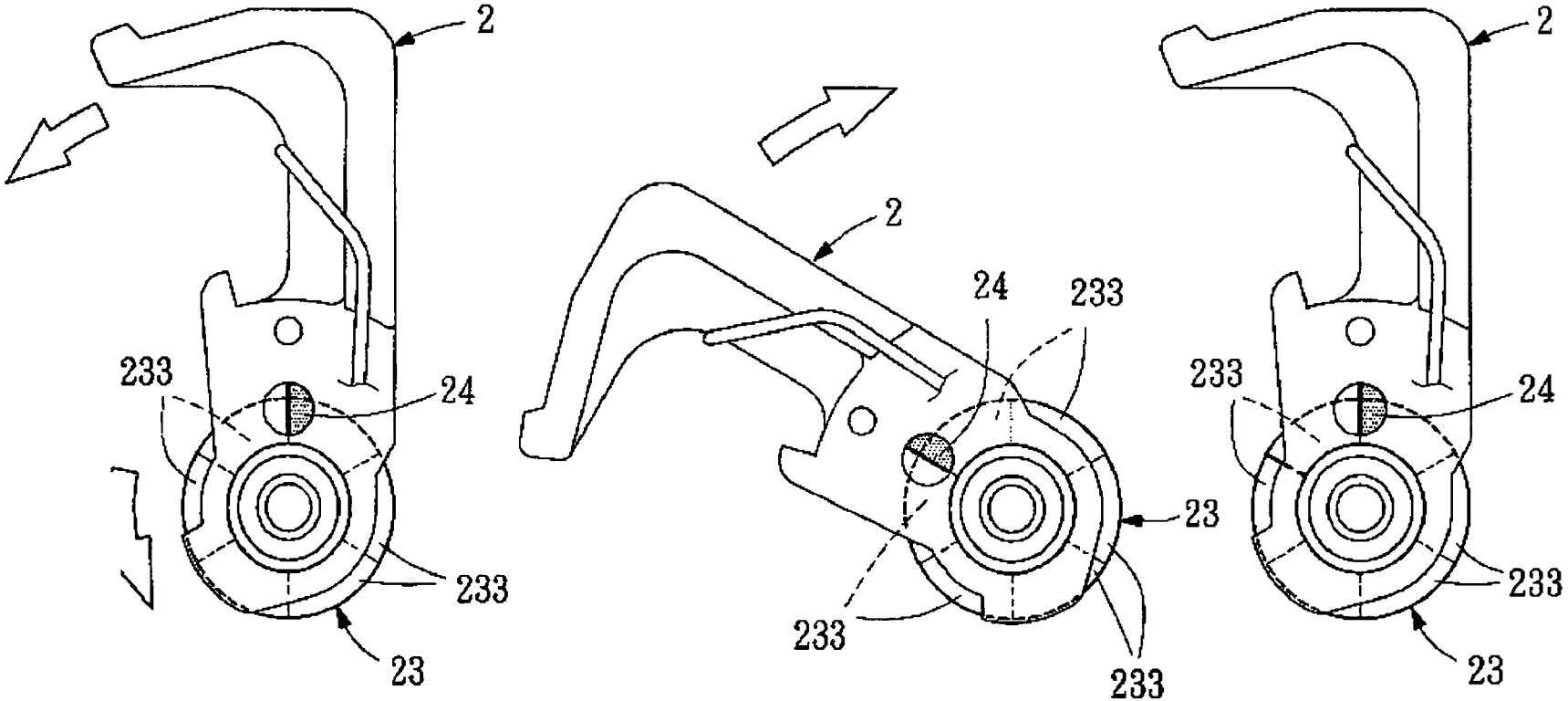
FIGS. 6~8 illustrate relative positioning between the stop rod of the hammer and the sloping teeth of the ratchet wheel during hammering action of the hammer.

The hammer 2 is pivotally mounted inside the gun body 200 beneath the bolt 1 (see FIGS. 2 and 3), having a hook portion 21 and an axle 22. A one-way ratchet wheel 23 is mounted on the axle 22 (see FIGS. 1, 3 and 4). The ratchet wheel 23 has two series of teeth arranged around the periphery at one side, each series of teeth including two shadow teeth 231 and one deep tooth 232, and a plurality of sloping teeth 233 arranged around the periphery at an opposite side (see FIGS. 4 and 6~8). The number of the sloping teeth 233 is equal to the total number of the shadow teeth 231 and deep teeth 232. According to the present preferred embodiment, the ratchet wheel 23 has 6 sloping teeth 233 equiangularly arranged around the periphery. The hammer 2 has a stop rod 24 connected thereto. The stop rod 24 has its front end stopped against one sloping tooth 233 (see FIGS. 5 and 6). Further, the ratchet wheel 23 is rotated with down stroke of the hammer 2 (see FIGS, 6 and 7) and the stop rod 24 is moved into engagement with another sloping teeth 233 after return of the hammer 2 (sac FIG, 8), prohibiting the ratchet wheel 23 from a reverse rotation. Further, the stop rod 24 extends through the hammer 2. Further, a spring member 25 is mounted in the hammer 2 and stopped between the rear end of the stop rod 24 and a locating plate 26 that is affixed to one side of the hammer 2. Further, the hammer 2 has a retaining portion 27 at the top side.

The trigger 3 has a holder portion 32 mounted in the gun body 200, and a trigger lever 31 extended from the holder portion 32 and suspending outside the gun body 200 (see FIG. 2).

The switch 4 comprises a handle 41 and a link 42. The link 42 has at least three cuts 43 (for example, three cuts as shown in FIG. 1). By means of biasing the handle 41, the direction of the cuts 43 is changed.

Figure 9:
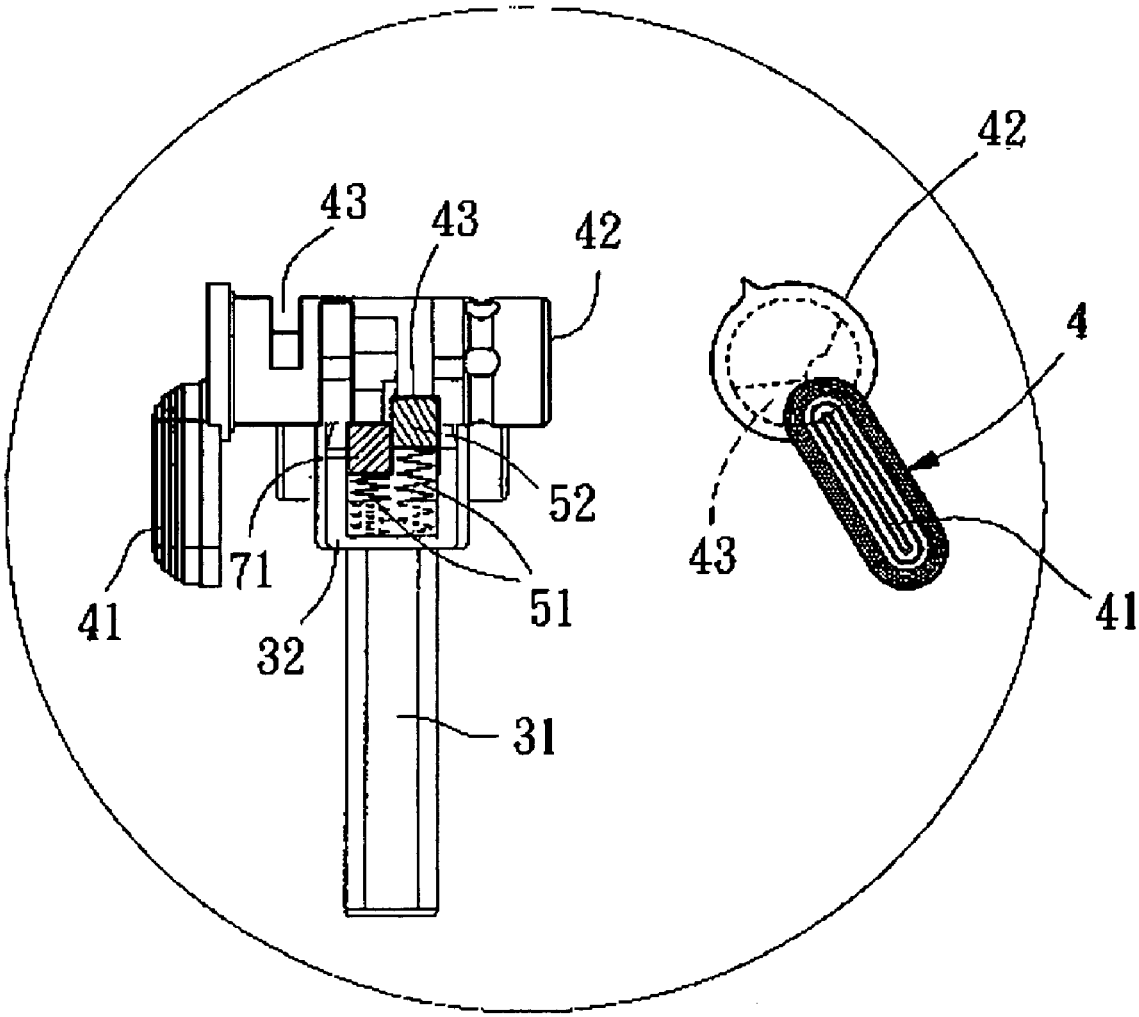
FIG. 9 is a schematic drawing of the present invention, showing the structure and positioning of the switch during a single shot firing operation of the firing control mechanism.

The hammer hook 5 and the trigger 3 are pivotally mounted together in the gun body 200, having a rear bearing portion 52. Further, a spring member 51 is set between the holder portion 32 of the trigger 3 and the hammer hook 5. By means of inserting the rear bearing portion 52 of the hammer hook 5 into one cut 43 of the switch 4 to release pressure from the associating spring member 51 (see FIG. 9), the hammer hook 5 can be hooked on the hooked portion 21 of the hammer 2 (see FIG. 2), and the trigger 3 can be unlocked for enabling the hammer 2 to be biased, achieving a single-shot firing.

Figure 10:
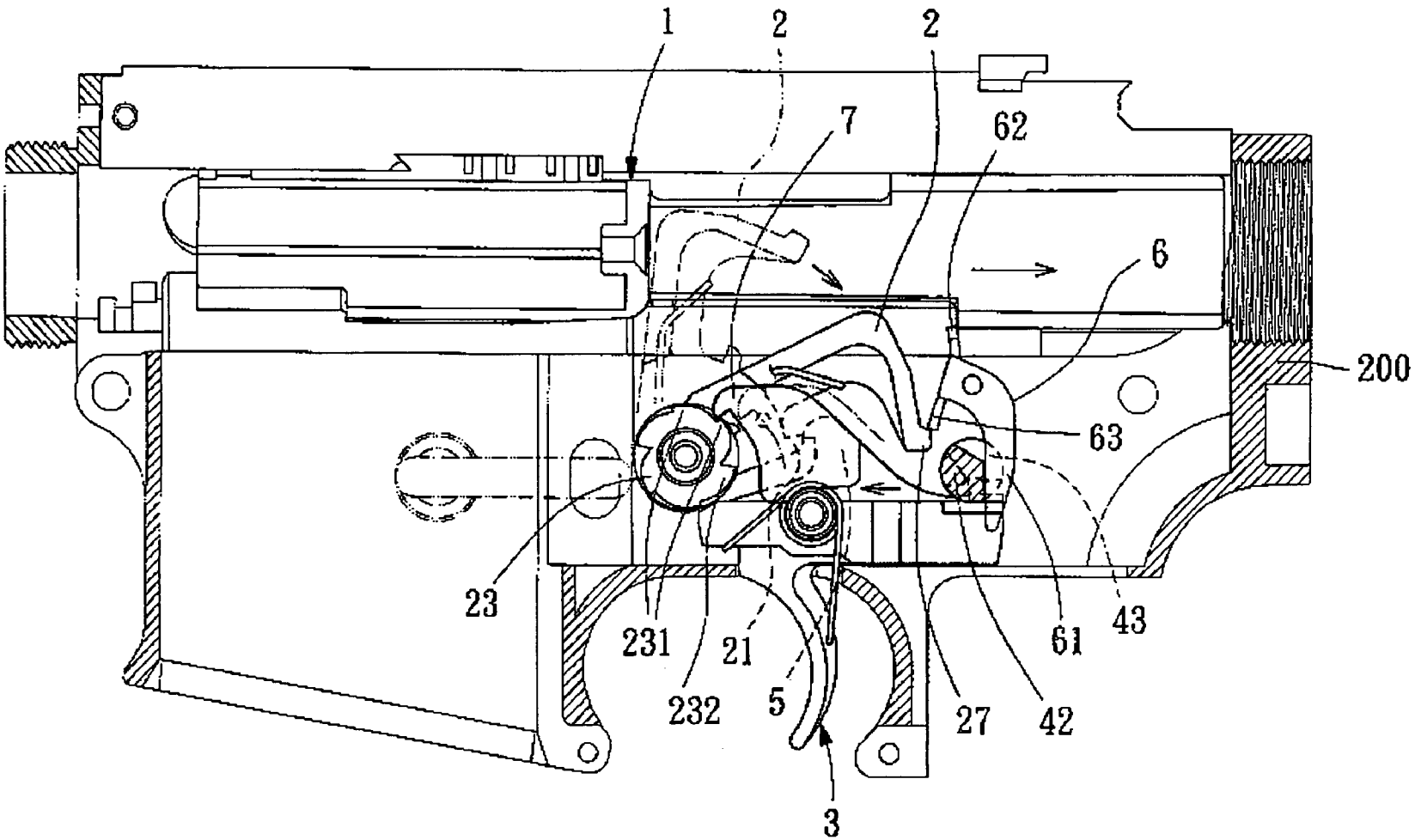
FIG. 10 is a schematic drawing of the present invention, showing the status of the firing control mechanism at the first shot during a continuous 3-shot firing operation.
Figure 12:
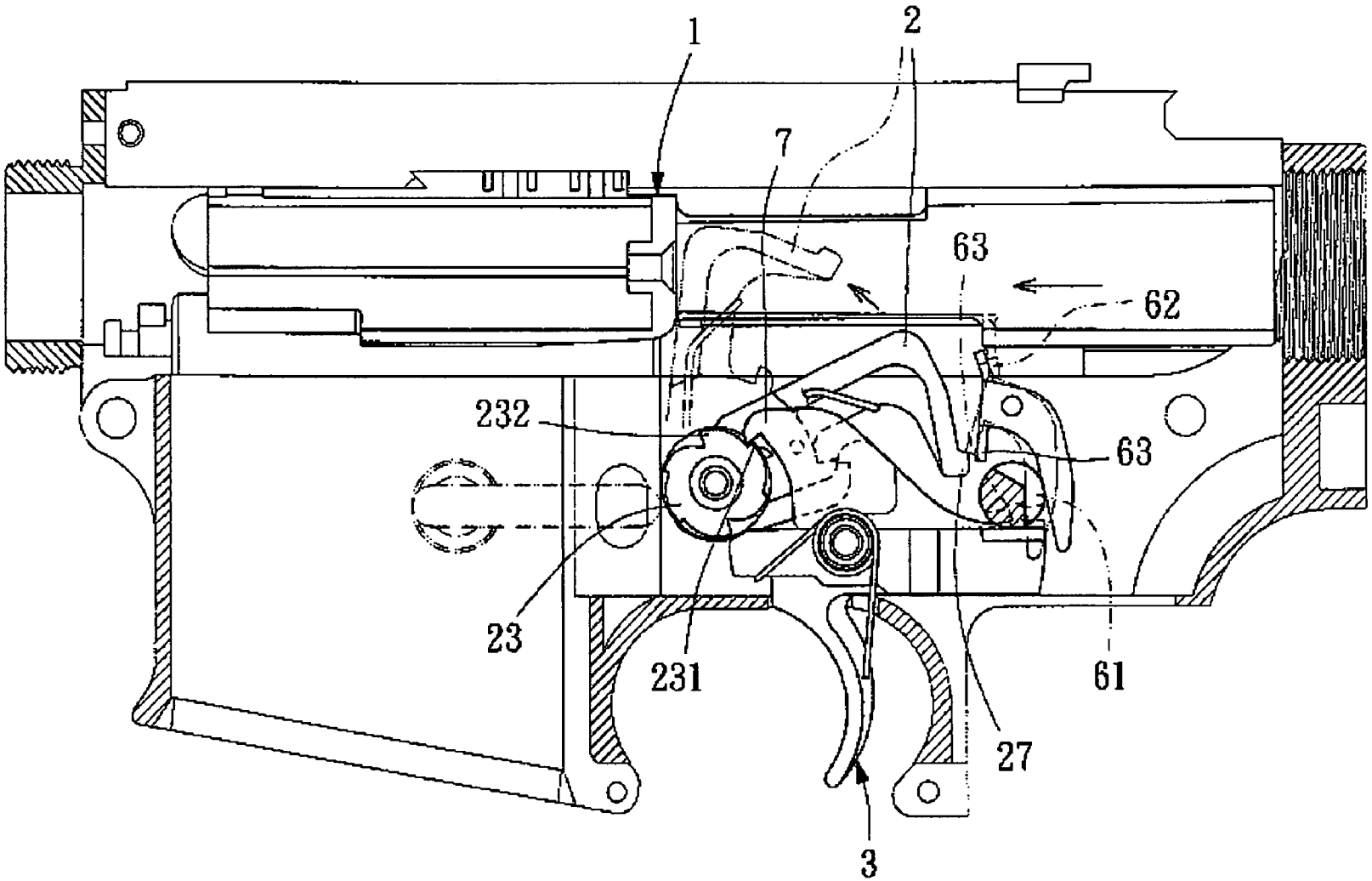
FIG. 12 is a schematic drawing of the present invention, showing the status of the firing control mechanism at the second shot during a continuous 3-shot firing operation.
Figure 13:
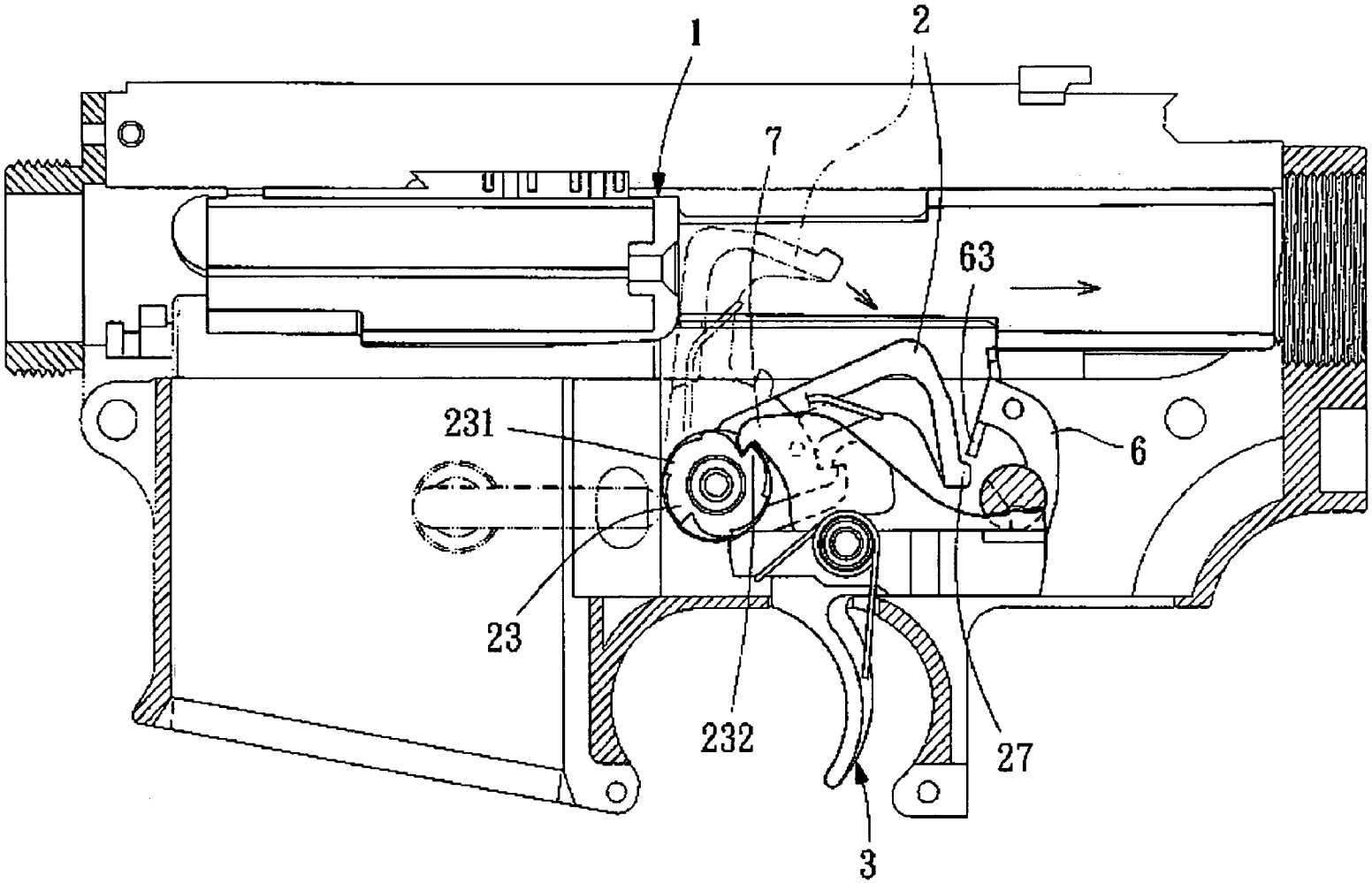

Further, a pawl 7 is provided at one side of the hammer hook 5. The pawl 7 and the trigger 3 are pivotally mounted together in the gun body 200, having a rear bearing portion 71. Further, a spring member 51 is set between the holder portion 32 of the trigger 3 and the pawl 7. By means of inserting the rear bearing portion 71 of the pawl 7 into one cut 43 of the switch 4 to release pressure from the associating spring member 51 (see FIG. 11), the pawl 7 can be hooked on one shadow tooth 231 of the ratchet wheel 23 (see FIG. 10). At this time, the hammer hook 5 is not hooked on the hooked portion 21 of the hammer 2, and the continuous firing control rod 6 has the bearing portion 61 thereof inserted into one cut 43 of the switch 4 and the top end 62 thereof protruding upwards and the bottom end 63 thereof secured to the retaining portion 27 of the hammer 2. When pressing the trigger 3 at this time, a first shot is fired, and the bolt 1 is forced backwards by the pressure of the discharged gas to return the hammer 2 for enabling the bottom end 63 to be secured to the retaining portion 27 of the hammer 2 so that the bolt 1 is pushed forward to fire a second shot (see FIG. 12) and then a third shot (see FIG. 13). When the third shot is fired, the pawl 7 is forced into engagement one deep tooth 232 of the ratchet wheel 23, and the bottom end 63 is kept away from the retaining portion 27 of the hammer 2. When release the trigger 3 and then press the trigger 3 again at this time, a next three continuous shots will be fired again.

Figure 11:
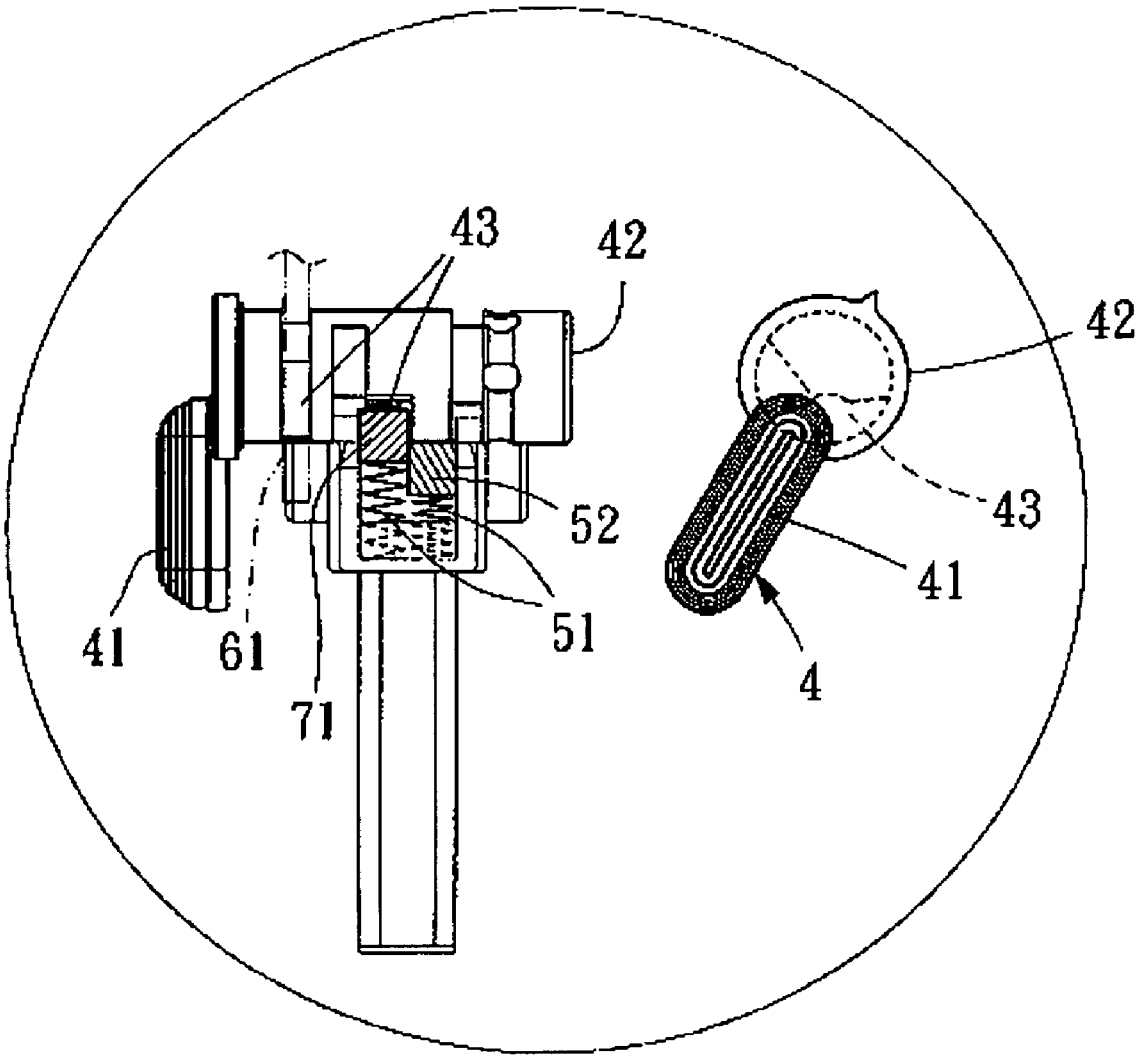
FIG. 11 is a schematic drawing of the present invention, showing the structure and positioning, of the switch during a continuous 3-shot firing operation of the firing control mechanism.

As stated above, the continuous firing control rod 6 has the aforesaid bearing portion 61, top end 62 and bottom end 63. When rotate the switch 4 to the continuous 3-shot position (as shown in FIG. 11) or continuous multi-shot position (as shown in FIG. 15), the rear bearing portion 61 is forced into one cut 43 of the switch 4, and the bottom end is secured to the retaining portion 27 of the hammer 2 (see FIGS. 10 and 14). When in the continuous multi-shot position, the hammer hook 5 and the pawl 7 are not retained together (see FIG. 14), and multiple shots will be continuously fired when pressing the trigger 3 at this time. Further, when rotating the switch 4 to the safety position, the bearing portion 61 is kept away from the cuts 43 of the switch 4, and the continuous firing control rod 6 is free from the action of the bolt 1, assuring safety locking.

As stated above, by means of rotating the switch 4 to change the position of the cuts 42 and forcing the bearing portions 52, 71 or 61 of the hammer hook 5, pawl 7 or continuous firing control rod 6 in or out of one cut 43 of the switch 4, the air-soft toy gun is controlled to achieve a single shot firing, continuous 3-shot firing, multi-shot firing or safety locking mode. When entering the continuous 3-shot firing mode, the sloping teeth 233 of the ratchet wheel 23, of which the total number is equal to the total number of the shadow teeth 231 and deep teeth 232, is kept in mesh with the stop rod 24 of the hammer 2. The ratchet wheel 23 is rotated following down stroke of the hammer 2. When the hammer 2 is returned after a firing action, the stop rod 24 is shifted into engagement with another sloping tooth 233, preventing reverse rotation of the ratchet wheel 23.

A prototype of firing control mechanism for toy gun has been constructed with the features of FIGS. 1~15. The firing control mechanism for toy gun functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A firing control mechanism used in an air-soft toy gun, comprising a bolt, a hammer, a trigger, a switch, a hammer hook, a continuous firing control rod, said hammer having a hooked portion located on a bottom side thereof for hooking by said hammer hook and an axle, a ratchet wheel mounted on said axle of said hammer and rotatable on said axle in one single direction, said ratchet wheel having at least one series of shadow and deep teeth arranged around the periphery thereof at one side, each said series of teeth comprising two shadow teeth and one deep tooth, a pawl provided at one side of the hammer hook for engaging said ratchet wheel, said switch comprising a link, said link having at least three cuts, the position of said at least three cuts being changed relative to said hammer hook, said pawl and said continuous firing control rod when said switch is rotated, said hammer hook, said pawl and said continuous firing control rod each having a bearing portion respectively controllable to engage one said cut for entering one of single shot firing mode, 3-shot continuous firing mode, multi-shot continuously firing mode and safety lock mode;

wherein said ratchet wheel has a plurality of sloping teeth equiangularly arranged around the periphery thereof at an opposite side relative to said at least one series of shadow and deep teeth, the number of said sloping teeth being equal to the total number of the teeth of said at least one series of shadow and deep teeth; said hammer has a stop rod meshed with one said sloping tooth of said ratchet wheel, said stop rod of said hammer being shifted into mesh with a next sloping tooth of said ratchet wheel to prohibit reverse rotation of said ratchet when said hammer is returned after a forward rotation subject to a hammering action of said hammer.

2. The firing control mechanism as claimed in claim 1, wherein said stop rod extends through said hammer, having a rear end supported on a spring member at said hammer.

3. The firing control mechanism as claimed in claim 2, wherein said hammer has a locating plate affixed to one side thereof and stopped at one side of said spring member against the rear end of said stop rod.

* * * * *